US007781951B2

(12) United States Patent
Tanino et al.

(10) Patent No.: US 7,781,951 B2
(45) Date of Patent: Aug. 24, 2010

(54) FILAMENT LAMP

(75) Inventors: Kenji Tanino, Himeji (JP); Shinji Taniguchi, Himeji (JP); Yukio Ueshima, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 35 days.

(21) Appl. No.: 12/402,853

(22) Filed: Mar. 12, 2009

(65) Prior Publication Data

US 2009/0243456 A1 Oct. 1, 2009

(30) Foreign Application Priority Data

Mar. 27, 2008 (JP) ..... 2008-082458

(51) Int. Cl.
*H01J 1/20* (2006.01)

(52) U.S. Cl. ..... 313/338; 313/272

(58) Field of Classification Search ..... 313/491, 313/623, 631, 272, 338, 344
See application file for complete search history.

(56) References Cited

U.S. PATENT DOCUMENTS

| | | | | |
|---|---|---|---|---|
| 3,225,247 | A * | 12/1965 | Audesse et al. | 313/271 |
| 3,364,377 | A * | 1/1968 | De Nygorden et al. | 313/272 |
| 6,876,816 | B2 | 4/2005 | Shigeoka et al. | |
| 2006/0197454 | A1 | 9/2006 | Mizukawa et al. | |

FOREIGN PATENT DOCUMENTS

| | | | |
|---|---|---|---|
| JP | 7-37833 | A | 2/1995 |

* cited by examiner

*Primary Examiner*—Vip Patel
(74) *Attorney, Agent, or Firm*—David S. Safran; Roberts Mlotkowski Safran & Cole, P.C.

(57) ABSTRACT

To provide a filament lamp having a plurality of filaments disposed in sequence in the axial direction of a light-emitting lamp tube which is configured so as not to shield emitted light from a center filament, internal leads for two filaments disposed proximate hermetically sealed parts at both ends are connected to metal foils in the same hermetically sealed part.

2 Claims, 5 Drawing Sheets

FILAMENT LAMP

BACKGROUND OF THE INVENTION

1. Field of Invention

The present invention relates to a filament lamp, and in particular, to a filament lamp used to heat an article to be treated.

2. Description of Related Art

Heat treatment devices capable of heating an article to be treated without making contact by optical irradiation from an incandescent lamp or other light source in which filaments are disposed inside a light-emitting tube composed of optically transparent material, for example, are widely used as heat treatment devices in rapid thermal processing (RPT) employed during the film formation, oxidation, impurity dispersion, nitriding, film stabilization, silicidation, crystallization, and ion implantation processes that are part of the semiconductor manufacturing process (see Japanese Unexamined Patent Application JP 7-37833 and Japanese Unexamined Patent Application JP 2002-203804).

One of the present inventors, with others, has proposed a filament lamp having the following configuration, using an optical irradiating type heat treatment device as a light source (see, commonly owned, Japanese Unexamined Patent Application JP 2006-279008 and corresponding U.S. Patent Application Publication 2006/0197454).

Describing this filament lamp in reference to FIG. 5, coil-shaped filaments 4, 5, and 6 are disposed in sequence extending in the tube axis direction of a light-emitting tube 1, within a straight-tube shaped light-emitting tube 1 wherein both ends are sealed airtight by end seals 2*a* and 2*b*. Both ends of the filaments 4, 5, and 6 have internal leads 4*a*, 4*b*, 5*a*, 5*b*, 6*a*, and 6*b* connected for supplying electric current.

The internal leads of each filament extend to the respective end seals and are electrically connected to external leads separately via metal foils. In other words, the internal leads 4*a*, 5*a*, and 6*a* on one end of each of the filaments 4, 5, and 6 are electrically connected to the external leads 10*a*, 11*a*, and 12*a* by metal foils 7*a*, 8*a*, and 9*a* on the end seals 2*a*. Similarly, the internal leads 4*b*, 5*b*, and 6*b* on the other end are electrically connected to the external leads 10*b*, 11*b*, and 12*b* by the metal foils 7*b*, 8*b*, and 9*b* on the end seal 2*b*.

In addition, each of the filaments 4, 5, and 6 can be supplied with electric current separately by being connected to separate electric current supply devices 13, 14, and 15 by the external leads 10*a*, 10*b*, 11*a*, 11*b*, 12*a*, and 12*b*.

Insulating tubes 16, 17, and 18 are fitted onto the internal leads 4*b*, 5*a*, 5*b*, 6*a* of the filaments 4, 5, 6, disposed at locations opposite the filaments 4, 5, 6.

In addition, circular anchors 19, 20, 21 are disposed alongside in the tube axis direction of the light-emitting tube 1 at locations between the inner wall of the light-emitting tube 1 and the insulating tubes 16, 17, 18. The filaments 4, 5, 6 are each supported by 2 anchors, for example, without making contact with the light-emitting tube 1.

Since electrical current can be supplied separately to a plurality of filaments and control performed separately for illumination, etc., of each filament using an optical irradiation type heat treatment device using filament lamps of this configuration, optical irradiation is possible with a preferred radiation intensity according to the properties of the article to be treated, even in a case, for instance, in which the distribution of the degree of localized temperature change on the article to be treated is asymmetrical with respect to the shape of the article to be treated. As a result, the article to be treated can be uniformly heated, and as a consequence, uniform temperature distribution can be realized across the entirety of the irradiated surface on the article to be treated, which confers a benefit.

In the conventional technology as described above, insulating tubes 16, 17, 18 are fitted in order to prevent electrical discharge between each filament 4, 5, 6 and the internal leads 4*a*, 5*a*, 5*b*, 6*a*. Accordingly, the light emitted from the filaments sometimes is blocked by the insulating tubes, causing the illumination distribution on the irradiated surface of the article to be treated to not be uniform, and thus, making it impossible to make the temperature distribution uniform, which is problematic.

Blockage of the emitted light from the central filament, disposed directly above the center of the article to be treated, exerts a highly adverse impact on the uniformity of temperature distribution on the article to be treated.

The foregoing description cited an example of fitting insulating tubes onto the internal leads, but even in a case in which no insulating tubes are present, the same problem of blockage of emitted light occurs.

SUMMARY OF THE INVENTION

Taking note of the foregoing problem with conventional technology as described above, the present invention seeks to provide a filament lamp having a plurality of coil-shaped filaments disposed within a light-emitting tube, configured to be effectively usable without the emitted light from the filament disposed in the center in the tube axis direction of the light-emitting tube being shielded.

The present invention is characterized by having three or more coil-shaped filaments disposed in sequence in the tube axis direction inside a light-emitting tube upon which are formed hermetically sealed parts at both ends, and having a pair of internal leads attached at both ends of each filament, with each internal lead electrically connected to a plurality of sheets of metal foil embedded in the hermetically sealed parts; wherein the pairs of internal leads attached to both ends of two of the filaments disposed in the proximity of each of the hermetically sealed parts extend in the direction of the same hermetically sealed part in the proximity of the filament, and are supported by the hermetically sealed parts; and wherein the pairs of internal leads attached to both ends of the filament disposed between the two filaments extend in mutually differing directions in the tube axis direction of the light-emitting tube, and are supported by the hermetically sealed parts on both ends.

The present invention is further characterized by having glass bridges disposed in the proximity of the hermetically sealed parts supporting each of the internal leads extending toward the hermetically sealed parts, and by having a wire-shaped anchor wherein the filaments disposed in the proximity of the hermetically sealed parts are supported on one end by said filament and on the other end by each of the glass bridges extending in the tube axis direction of the light-emitting tube.

Since the filament lamp according to the present invention is configured so that the internal leads for the filaments disposed in the proximity of the hermetically sealed parts at both ends are supported by the same hermetically sealed parts, the number of internal leads extending into proximity with the filament disposed in the center can be reduced, and the shielding of emitted light caused by insulating tubes fitted onto the internal leads can be reduced, which confers a benefit. As a result, the light emitted from the filament disposed directly above the treated article to be treated can uniformly irradiate the article to be treated.

DETAILED DESCRIPTION OF THE INVENTION

Figure 1:
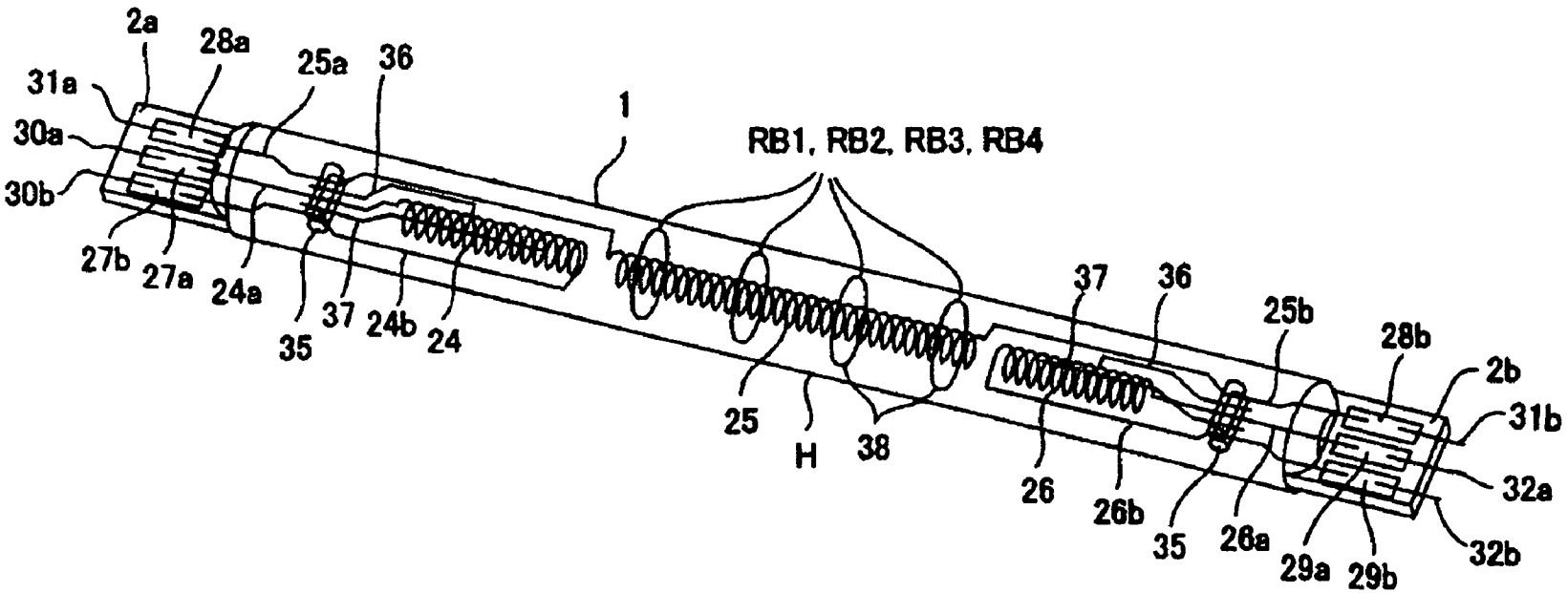
FIG. 1 is a perspective view of a first embodiment of the filament lamp according to the present invention.
Figure 2:
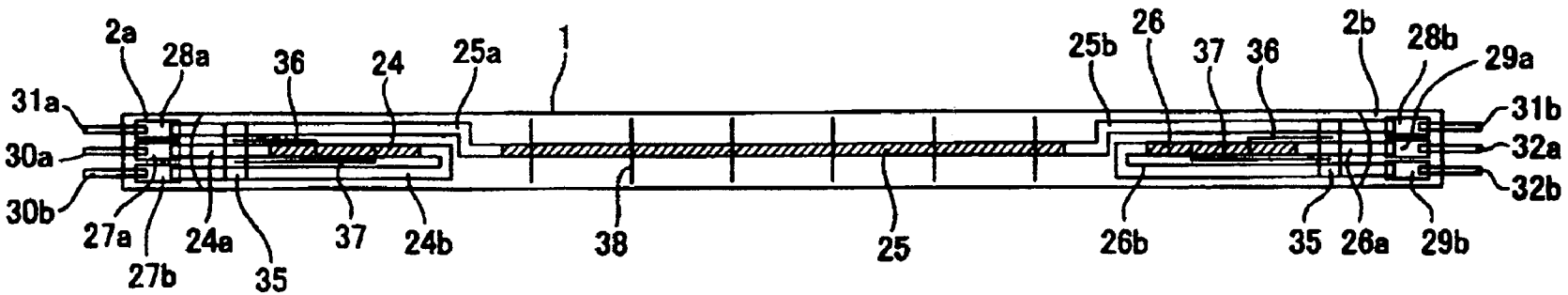
FIG. 2 is plan view of the filament lamp shown in FIG. 1.

FIGS. 1 & 2 show the overall configuration of the filament lamp according to a first embodiment of the present invention.

Three filaments 24, 25, 26 are disposed together inside a light-emitting tube 1 extending in the tube axis direction thereof. Internal leads 24*a*, 24*b* for the filament 24, proximate to a hermetically sealed part 2*a* at one end, are connected to the respective ends of the filament 24 extending from the hermetically sealed part 2*a*. These internal leads 24*a*, 24*b* are both supported so as to connect with a respective metal foil 27*a*, 27*b* in the same hermetically sealed part 2*a*.

At the same time, the internal leads 25*a*, 25*b* on the filament 25 disposed at the center extend to the hermetically sealed parts 2*a*, 2*b* and are supported so as to connect with metal foils 28*a*, 28*b*, respectively, in the hermetically sealed parts 2*a*, 2*b* at each end.

Regarding the filament 26 proximate to the hermetically sealed part 2*b* at the other end, as with filament 24 described above, the internal leads 26*a*, 26*b* are supported so as to connect with metal foils 29*a*, 29*b*, respectively in the hermetically sealed part 2*b* at the other end.

Connected to metal foils 27*a*, 27*b*, 28*a*, 28*b*, 29*a*, 29*b* are respective external leads 30*a*, 30*b*, 31*a*, 31*b*, 32*a*, 32*b*.

Figure 3:
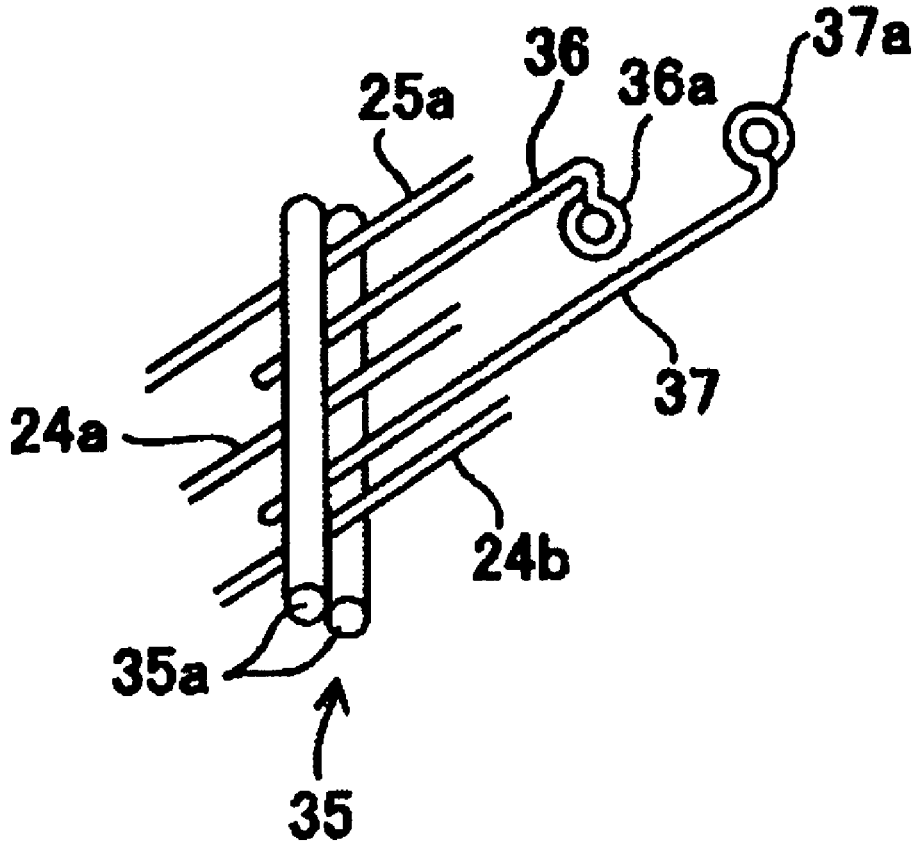
FIG. 3 shows a portion of the filament lamp shown in FIG. 1 in the area of glass bridges used to support internal leads of the lamp.

In addition, glass bridges 35, 35 are disposed in proximity to the hermetically sealed parts 2*a*, 2*b* inside the light-emitting tube 1. As shown in FIG. 3, the glass bridge 35 is composed of a pair of conical glass members 35*a* that sandwich the internal leads 24*a*, 24*b*, 525*a* and the interspersed cylindrical anchors 36, 37 between them. Ring portions 36*a*, 37*a* at the tips of the anchors 36, 37 are attached to the filament 24 in three equal segments in the lengthwise direction of the filament 24. Also, ring-shaped anchors 38 support the center filament 25 as shown in FIG. 1.

Figure 5:
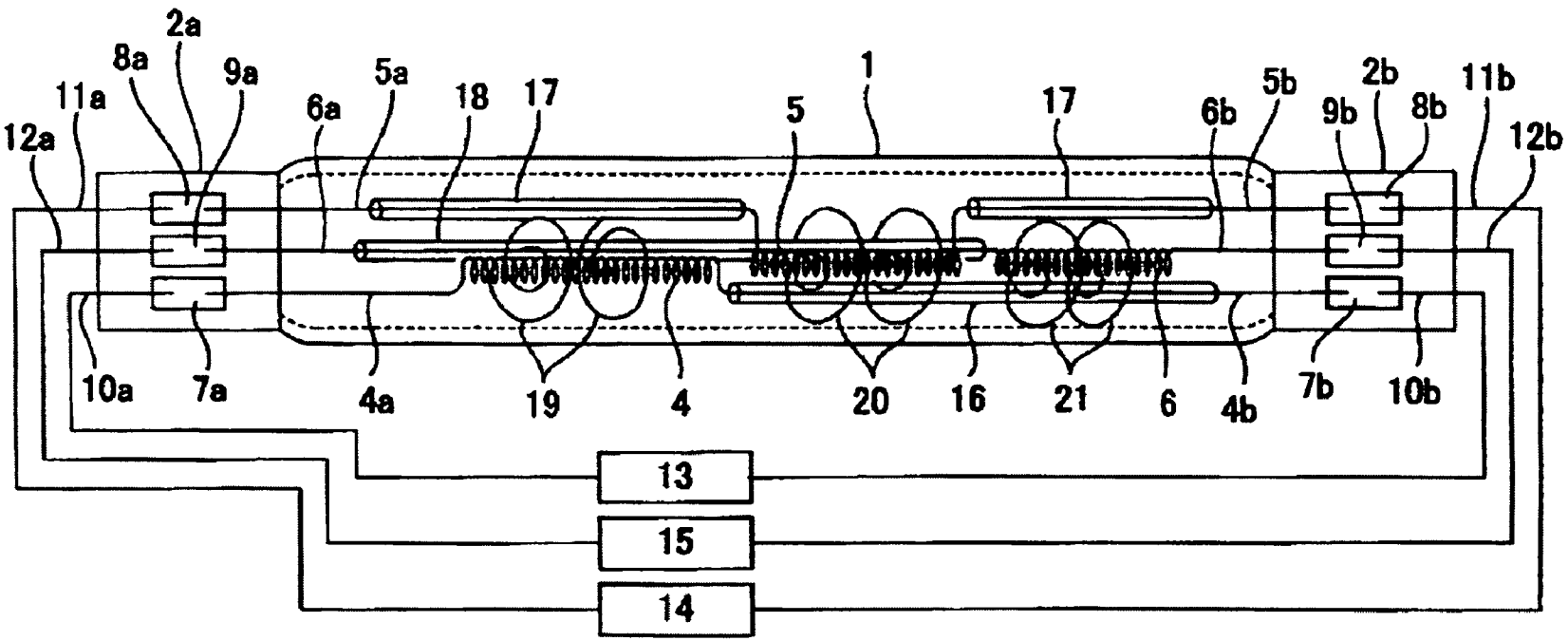
Fig. 5 (Prior Art)
FIG. 5 illustrates a conventional filament lamp.

The structure described above has no insulating tubes fitted onto the internal leads 24*b*, 25*a*, 25*b*, 26*b*. However, a structure in which insulating tubes are fitted as in conventional lamp shown in FIG. 5 is acceptable, of course.

By adopting the configuration described above, no internal leads extend into proximity with the center filament 25 and light irradiated from the filament 25 disposed directly above the article to be treated is not blocked by any internal leads or any insulating tubes fitted thereon, thus achieving uniform irradiation.

Regarding the number of internal leads extending into proximity with the filaments 24, 26 disposed near both end hermetically sealed parts, the number is the same as in the conventional lamp. These filaments generally correspond to guard rings (not shown) at the periphery of the mounting platform where the article to be treated is mounted, and the effect of these internal leads is slight.

Figure 4:
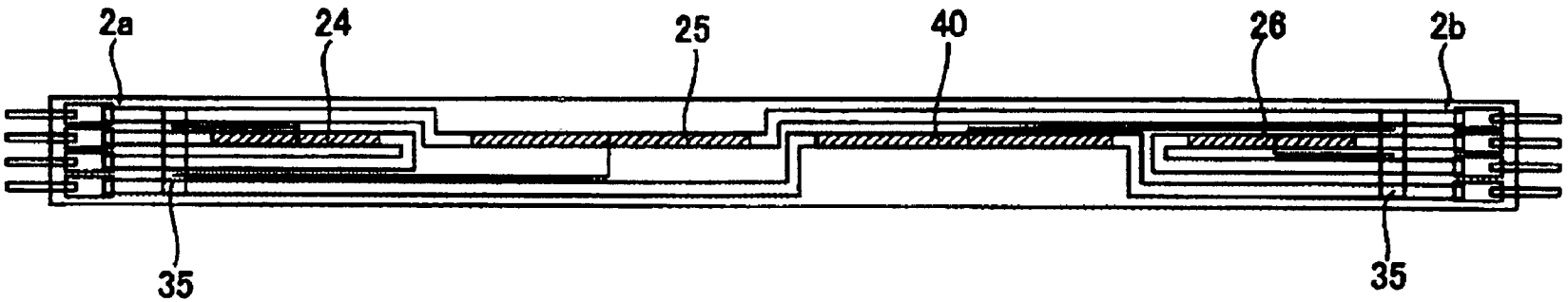
FIG. 4 is plan view of a second embodiment of the filament lamp according to the present invention.

The embodiment described above has three filaments. However, the present invention is not limited to this configuration, and can be applied to a lamp with four filaments as well, as shown in FIG. 4. A detailed discussion is omitted here, but as with the embodiment described above, in this case as well, the internal leads for the filaments 24, 26 disposed proximate the hermetically sealed parts on both ends may be connected to a metal foil extending in the direction of the same hermetically sealed parts 2*a*, 2*b*, respectively, as in the embodiment shown in FIG. 2. The internal leads on both ends of the other center filaments 25, 40 are sealed extending to the hermetically sealed parts 2*a*, 2*b* on both ends respectively.

As is apparent from the foregoing descriptions, even in a case in which the number of filaments is even greater, such as five filaments, for instances, similarly, the internal leads for the two filaments disposed at the proximity of the hermetically sealed parts on both ends may have the same configuration.

By adopting this configuration, the number of internal leads extending to the proximity of the filaments disposed in the center in the lamp axis direction can be reduced by two leads (corresponding to the number of filaments at the hermetically sealed parts at both ends) in comparison to conventional technology, in which the internal leads for all filaments extend to the hermetically sealed parts in both directions, thereby reducing the shielding of irradiated light.

What is claimed is:

1. A filament lamp, comprising:

an elongated light-emitting lamp tube having hermetically sealed parts formed at each of opposite ends thereof;

a plurality of metal foils embedded in each of the hermetically sealed parts of the lamp tube;

at least three coil-shaped filaments disposed in sequence in an axial direction of the lamp tube axis, and pairs of internal leads, each lead of which is attached to a respective end of a respective filament, with each internal lead being electrically connected to a respective one of said plurality of sheets of metal foil;

wherein the pairs of internal leads attached to both ends of those of the filaments which are disposed in proximity to the hermetically sealed parts extend in the direction of the same hermetically sealed part and are supported by a respective one of the hermetically sealed parts; and wherein the pairs of internal leads attached to the ends of at least one filament that is disposed between the filaments that are proximate the hermetically sealed parts extend in mutually differing directions in the tube axis direction of the light-emitting tube, and each of which is supported by a respective one the hermetically sealed parts.

2. The filament lamp of claim 1, further comprising glass bridges disposed in proximity to each of the hermetically sealed parts and supporting the internal leads extending toward the respective hermetically sealed part, and wire-shaped anchors each of which supports a respective end of the filaments disposed proximate the hermetically sealed parts at one end of the anchor and on the other end of each anchor being supported by the glass bridges disposed in proximity to the respective hermetically sealed part.

* * * * *